US006540233B2

(12) United States Patent
Battistoni et al.

(10) Patent No.: US 6,540,233 B2
(45) Date of Patent: Apr. 1, 2003

(54) EXHAUST MANIFOLD GASKET WITH INTEGRAL HEAT SLEEVE

(75) Inventors: Daniel C. Battistoni, West Chicago, IL (US); James T. Mikos, Westchester, IL (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/839,655

(22) Filed: Apr. 20, 2001

(65) Prior Publication Data

US 2002/0153667 A1 Oct. 24, 2002

(51) Int. Cl.[7] ..... F02F 11/00
(52) U.S. Cl. ..... 277/591; 277/598
(58) Field of Search ..... 277/591, 594, 277/595, 597, 598

(56) References Cited

U.S. PATENT DOCUMENTS

| | | | | |
|---|---|---|---|---|
| 1,592,291 A | | 7/1926 | Bailey | |
| 1,627,167 A | | 5/1927 | Fitzgerald | |
| 2,813,692 A | | 11/1957 | Bremer et al. | 248/56 |
| 2,840,350 A | | 6/1958 | Pierce | 257/1 |
| 3,018,120 A | | 1/1962 | Vann | 285/55 |
| 3,819,208 A | * | 6/1974 | Janle | 285/363 |
| 4,549,741 A | | 10/1985 | Usher et al. | 277/236 |
| 4,948,153 A | | 8/1990 | Takahashi et al. | 277/235 B |
| 5,087,058 A | * | 2/1992 | Miura et al. | 277/595 |
| 5,150,572 A | * | 9/1992 | Johnson et al. | 123/193.5 |
| 5,360,219 A | | 11/1994 | Okuda et al. | 277/235 B |
| 5,414,993 A | * | 5/1995 | Kon | 123/193.5 |
| 5,593,745 A | * | 1/1997 | Haselkorn et al. | 138/145 |
| 5,924,701 A | * | 7/1999 | Schweiger | 277/597 |

FOREIGN PATENT DOCUMENTS

| | | |
|---|---|---|
| JP | 2001-50043 | * 2/2001 |
| JP | 2001-235033 | * 8/2001 |
| JP | 2001-289325 | * 10/2001 |

* cited by examiner

*Primary Examiner*—Anthony Knight
*Assistant Examiner*—Michael J. Kyle
(74) *Attorney, Agent, or Firm*—Rader, Fishman & Grauer, PLLC

(57) ABSTRACT

An improved exhaust manifold gasket for sealing between cylinder head port and flanged exhaust manifold of an internal combustion engine. The gasket includes an integral heat insulating sleeve for reducing thermal stresses on cylinder head port and gasket body, and is comprised of first and second metal layers fixedly secured together along a unitary plane. An aperture through the gasket provides for passage of high-temperature exhaust gases, wherein the first and second layers define at least one full sealing bead disposed about the circumference of the aperture. The second layer includes a plurality of circumferentially disposed leg portions symmetrically disposed about the exhaust aperture. The leg portions are adapted to receive the attached sleeve, which is positioned orthogonally to the unitary plane and adapted to extend into the exhaust port. The sleeve forms an insulating air gap between its exterior circumference and the interior circumference of the exhaust port.

12 Claims, 2 Drawing Sheets

EXHAUST MANIFOLD GASKET WITH INTEGRAL HEAT SLEEVE

BACKGROUND OF THE INVENTION

1. Field of Invention

The present invention relates to improved bolted-on automotive exhaust manifold gasket assemblies for internal combustion engines, and more particularly to such gaskets having improved heat insulating characteristics as compared to commonly known prior art exhaust manifold gaskets.

2. Description of the Prior Art

Those skilled in the art will appreciate the difficulty of maintaining a high quality seal between the cylinder head exhaust port of an internal combustion engine and the exhaust manifold normally secured thereto via flange. Typically, an exhaust manifold gasket interfaces with, i.e. is affixed between, the cylinder head exhaust port of the engine and the engine exhaust manifold, indeed one of the hottest areas of an exterior engine environment. As a result of widely varying thermal cycles and significant vibration, an exhaust gasket is subject to rapid deterioration if its design is inferior.

One means of enhancing longevity of such gaskets in recent years has been to bracket together the exhaust manifold gasket with an insulating sleeve installed into the cylinder head exhaust port for reducing thermal stresses on both the cylinder head port and the exhaust gasket body. The associated structure, however, has been formed in several pieces, and is thus relatively cumbersome to install on the assembly line, in addition to being costly as result of the necessity of manufacturing extra parts. A consolidation of parts would be an attractive solution to resolve the issue.

SUMMARY OF THE INVENTION

The present invention is an improved exhaust manifold gasket for sealing between a cylinder head exhaust port and a flanged exhaust manifold of an internal combustion engine. In a preferred form, the exhaust manifold gasket of this invention contains an integral heat-insulating sleeve for reducing thermal stresses on cylinder head port and gasket body. The gasket is comprised of first and second metal layers fixedly secured together along a unitary plane. The gasket includes one medially positioned aperture for the passage of high-temperature exhaust gases, wherein the first and second layers define at least one full sealing bead disposed about the circumference of the aperture. Bolthole apertures are spaced radially outwardly of the exhaust gas aperture, and the second layer includes a plurality of circumferentially disposed leg portions symmetrically disposed about the exhaust aperture. The leg portions are positioned orthogonally to the unitary plane, and adapted to receive the attached sleeve designed to extend into the exhaust port. The sleeve is laterally positioned so as to form an air gap between its exterior circumference and the interior circumference of the exhaust port.

DETAILED DESCRIPTION OF THE PREFERRED EMBODIMENTS

Figure 1:
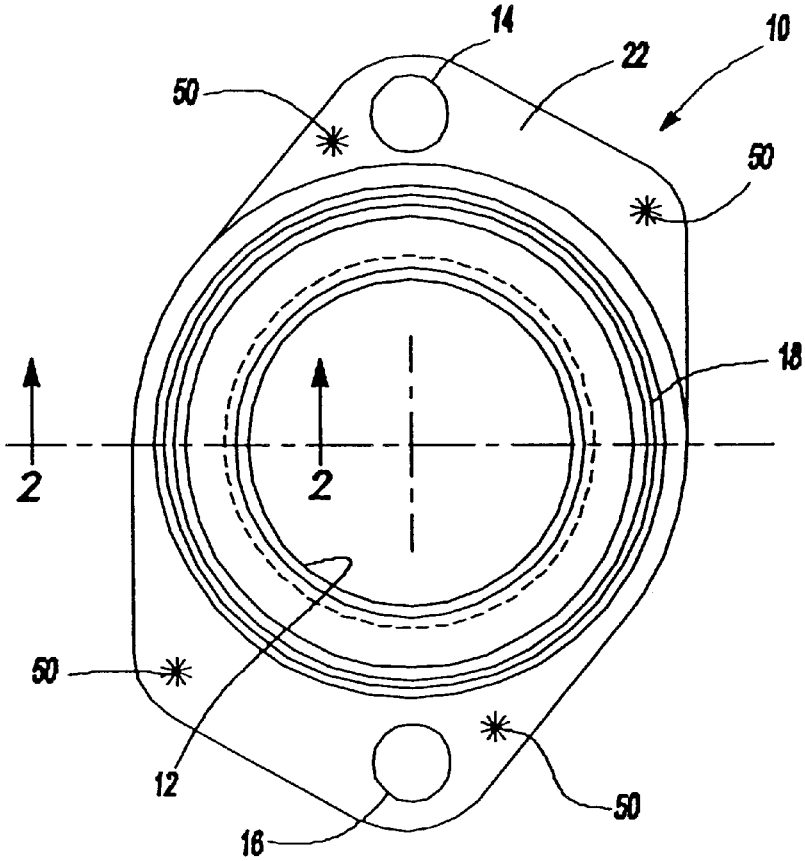
FIG. 1 is a plan view of one preferred embodiment of an exhaust manifold gasket that incorporates an insulating heat sleeve of the present invention.
Figure 3:
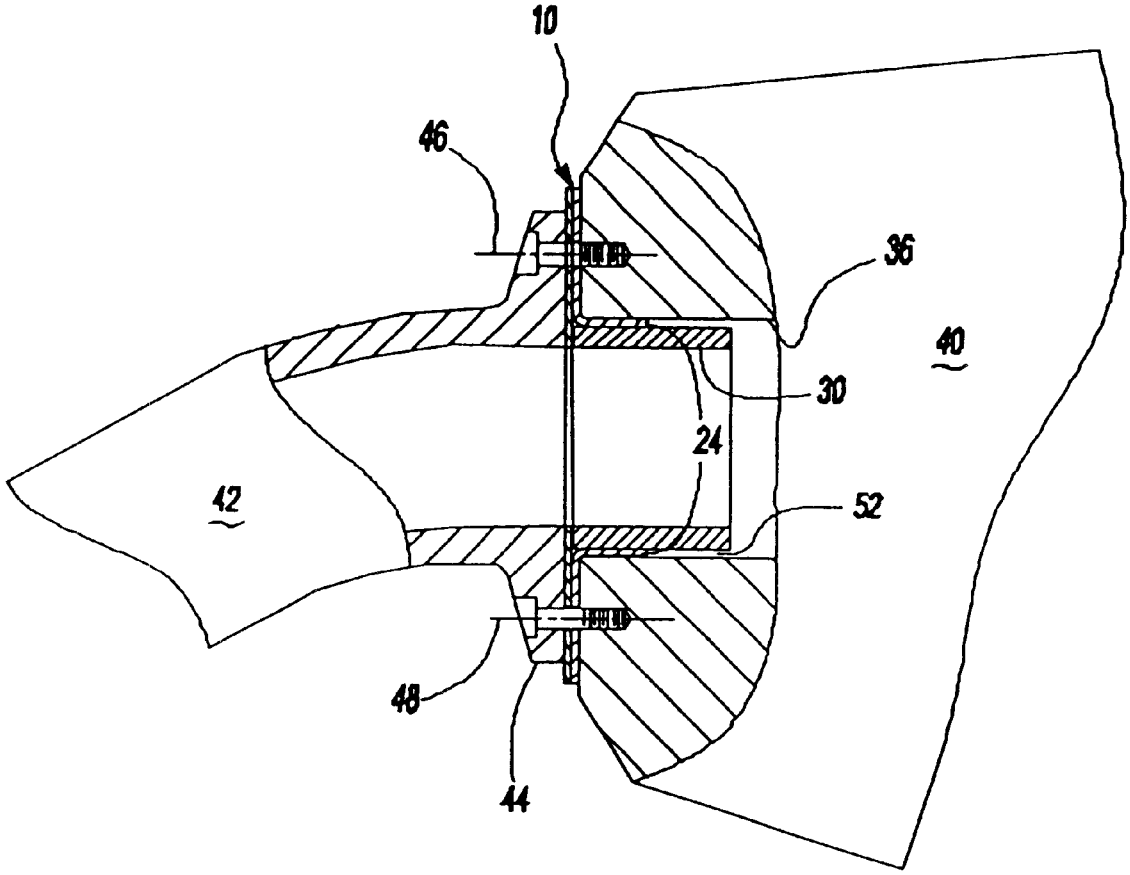
FIG. 3 is a view of the same preferred embodiment of the exhaust manifold gasket in its intended engine environment, interposed between a cylinder head exhaust port and an exhaust manifold flange, bolted into place as shown.

Referring initially to FIGS. 1 and 3, a preferred embodiment of an exhaust manifold gasket 10 has an aperture 12 in a medial portion of the gasket for passage of engine exhaust gases. The gasket 10 includes a pair of bolt apertures 14 and 16 at spaced apart edges thereof for securement of the gasket 10 between an exhaust port 36 of an internal combustion engine 40 and an exhaust manifold flange 44 of an exhaust manifold 42 attached to the port 36.

Figure 2:
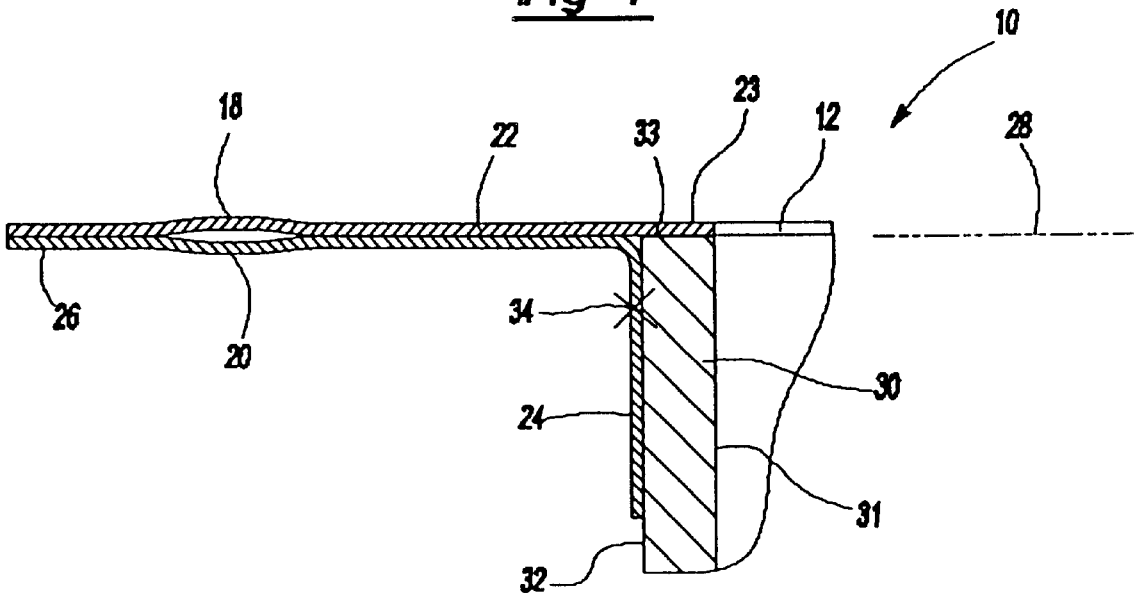
FIG. 2 is a cross-sectional view of a fragmentary portion of the same embodiment of the exhaust manifold gasket, along lines 2—2 of FIG. 1.

Referring now to FIG. 2, the gasket 10 includes an upper sealing bead 18 in an upper metal layer 22. The bead 18 is symmetrically aligned with and overlies a lower mating sealing bead 20 in a lower metal layer 26. The layers 22 and 26 are fixedly secured together e.g. via spot welds 50 (FIG. 1) along a unitary plane 28. Depending downwardly from the planar metal layer 26 is a plurality of circumferentially spaced orthogonal leg portions 24, positioned symmetrically with respect to the aperture 12. The portions 24 collectively define a circumferential retainer adapted to secure a cylindrical sleeve 30, which provides the gasket 10 with an integrally attached insulating heat sleeve. In the described preferred embodiment, the outside diameter 32 of the sleeve 30 is spot welded at locations 34 to the orthogonal legs 24. In one embodiment eight legs 24 are circumferentially spaced about the sleeve 32 and retain the sleeve to the described lower metal layer 26.

Referring now particularly to FIG. 3, a port 36 of an internal combustion engine 40 is shown in particular detail to demonstrate a preferred installation of the exhaust manifold gasket 10. Thus, an exhaust manifold 42 incorporates a flange 44 which mates with the port 36 via bolts (not shown) that extend through bolt centerlines 46 and 48 respectively. Those skilled in the art will appreciate that the bolts extend through bolt apertures 14 and 16 of the gasket 10, respectively, and that the positioning of the bolts will assure a symmetrical positioning of the sleeve 30 within the port aperature 36. In the example shown, the sleeve 30 is approximately 2.4 inches long and has an outside diameter of approximately 1⅞ in. Each of the legs 24 is approximately five millimeters or 0.2 inch wide. Also in the preferred embodiment, the sleeve is sized relative to the port 36 so as to define an insulating circumferential air gap 52 between the outside diameter of the sleeve 32 (FIG. 2) and the interior diameter of the port 36 of approximately 60 thousands of an inch.

With respect to other design parameters, the diameter of the aperture 12 will be controlled by the internal diameter 31 of the sleeve 30. Thus in the described embodiment, a radially inwardly extending flange portion 23 of the upper metal layer 22, situated at the boundary of the aperture 12, conveniently overlies the top 33 of the sleeve to provide an insertion limit of the sleeve 30 during assembly. Obviously, the sleeve 30 must be inserted between the retainer leg portions 24 prior to the spot welding thereof to the legs 24 as described. It will thus be apparent that the aperture 12 and the sleeve 30 will each necessarily be smaller in overall diameter than the diameter of the port 36.

It will be appreciated by those skilled in the art that sealing beads 18 and 20 are full beads as are used in metallic gaskets, and depending on the application only one circumferential bead may be necessary for a particular gasket design and installation and yet be within the scope of this invention.

Finally, the preferred metal to be used for both of the gasket metal layers 22 and 26, as well as for the sleeve 30, is stainless steel. This is because of the high temperature ranges to which the manifold exhaust system is normally subjected. Otherwise, the gasket 10 will have a short useful life due to the corrosive effects of oxidation. A preferred choice of a robust material for the intended environment is SAE 301 stainless steel for both layers and sleeve.

It is to be understood that the above description is intended to be illustrative and not limiting. Many embodiments will be apparent to those skilled in the art upon reading the above description. The scope of the invention should be determined, however, not with reference to the above description, but with reference to the appended claims with full scope of equivalents to which such claims are entitled.

What is claimed is:

1. An exhaust manifold gasket adapted for interposition between a cylinder head exhaust port defined by an interior wall and an exhaust manifold; said gasket comprising first and second metal layers fixedly secured together in a plane and having one medially positioned aperture therethrough, said first and second layers defining at least one full sealing bead about said aperture, said second layer including a plurality of circumferentially depending leg portions symmetrical with said aperture and orthogonal to said plane, wherein said gasket further comprises a cylindrical sleeve portion circumferentially attached to said leg portions, said sleeve extending orthogonally with respect to the said plane and parallel to said leg portions such that said leg portions are positioned between said sleeve and the wall of said exhaust port, said sleeve comprising a heat insulating medium adapted to extend into said cylinder head exhaust port, said sleeve being sized to define a circumferential air gap clearance between said cylindrical head exhaust port and said sleeve.

2. The exhaust manifold gasket of claim 1 further comprising said first and second metal layers secured together via welding, and wherein said aperture diameter is less than a diameter of said cylinder head exhaust port.

3. The exhaust manifold gasket of claim 1 wherein said gasket is adapted for being bolted into place between the cylinder head exhaust port and a flange of the exhaust manifold, wherein said first and second metal layers are welded via spot welding, and wherein said sleeve is attached to said leg portions via spot welding.

4. The exhaust manifold gasket of claim 3 wherein said plurality of circumferentially depending leg portions of said second metal layer define an internal diameter substantially equal to the external diameter of said sleeve, and wherein said sleeve is integrally fixed to said depending leg portions via welding.

5. The exhaust manifold gasket of claim 4 wherein said aperture and sleeve are adapted for symmetrical alignment with said cylinder head exhaust port.

6. The exhaust manifold gasket of claim 5 wherein said sleeve is adapted to extend into said external circumference of said cylinder head exhaust port, wherein said spacing is established via said bolted attachment.

7. The exhaust manifold gasket of claim 6 wherein said first metal layer defines an opening adapted to align with said internal diameter of said sleeve and is co-terminous therewith, wherein said diameter of said sleeve is smaller than said cylinder head exhaust port diameter.

8. The exhaust manifold gasket of claim 7 wherein said first layer comprises a radially inwardly extending flange portion that engages the top surface of said sleeve.

9. The exhaust manifold gasket of claim 8 wherein each of said metal layers comprises a sealing bead, the beads mated together symmetrically in said gasket.

10. The exhaust manifold gasket of claim 9 wherein said first and second metal layers comprise stainless steel.

11. The exhaust manifold gasket of claim 10 wherein said leg portions are attached to the outside diameter of said sleeve by spot welding.

12. The exhaust manifold gasket of claim 10 wherein said sleeve comprises a stainless-steel material.

* * * * *